US005425006A

United States Patent [19]

Ya

[11] Patent Number: 5,425,006

[45] Date of Patent: Jun. 13, 1995

[54] ALARM CLOCK

[76] Inventor: Songin Ya, 3Fl.-2, No. 406, Wanta Rd., Taipei, Taiwan, Prov. of China

[21] Appl. No.: 354,901

[22] Filed: Dec. 12, 1994

[51] Int. Cl.[6] ..... G04B 13/00

[52] U.S. Cl. ..... 368/262; 368/12; 368/243; 368/250

[58] Field of Search ..... 368/12, 243–269, 368/272

[56] References Cited

U.S. PATENT DOCUMENTS 4,282,596 8/1981 Siefert et al. ..... 368/262

4,449,833 5/1984 Montgomery ..... 368/262

*Primary Examiner*—Bernard Roskoski

*Attorney, Agent, or Firm*—Bacon & Thomas

[57] ABSTRACT

A rotatable alarm clock includes a clock body received in a hemispherical socket which is attached on a base. A plurality of hemispherical covers are rotatably received in a space defined between the alarm body and the hemispherical socket. An alarm switch is installed on the alarm body. A motor is positioned in the alarm body and is capable of driving the plurality of covers to rotate via a speed-reducing gear set. When the alarm clock alarms according to a preset time, the plurality of hemispherical covers are driven by the motor to rotate to cover the alarm clock body thus preventing a user to operate the alarm switch to turn off the alarm. The user has to concentrate his/her mind to rotate the hemispherical covers back to original positions to operate the alarm switch.

10 Claims, 7 Drawing Sheets

ALARM CLOCK

BACKGROUND OF THE INVENTION

1. Field of the Invention

The present invention relates to an alarm clock, and more particularly to an improved alarm clock having a plurality of covers preventing a user from turning off an alarming buzzer after he/she is waken up by the alarm from the buzzer.

2. Description of the Prior Art

Alarm clocks have been used for a long time, and many of them allow a user to turn off the alarm right after he/she is woken up by the alarm. A user is inclined to turn off the alarm and continue to sleep because the alarm is too easily turned off. Some of the alarm clocks can provide a snooze control button which when depressed will turn off the alarm for a predetermined time period, for example five minutes, thereafter the alarm will be automatically turned on and rewake the user. This kind of alarm clock can avoid the user to fall asleep over a predetermined time period, yet the user usually depresses the auxiliary button whenever the alarm is automatically turned on. Therefore a user might be late for a date or a job if he/she really gets up after he/she has depresses the snooze control button several times. It is believed that if the user is in a relatively conscious condition he/she will get up immediately after he is woken up. It is requisite to provide a new alarm clock which requires the user to concentrate his consciousness to turn off the alarm thus enabling the user to be in conscious condition before he/she turns off the alarm.

SUMMARY OF THE INVENTION

The primary objective of the present invention is to provide an improved alarm clock which requires the user to concentrate his/her consciousness to turn off the alarm therefrom before he/she turns off the alarm thus ensuring the user recovers full consciousness and gets up before the alarm is turned off.

In accordance with one aspect of the invention, there is provided an alarm clock comprising a base; a hemispherical socket attached on the base and including an inner tab projected from an inner periphery thereof; a shaft passing through an axis defined in the hemispherical socket and having two distal ends attached to the hemispherical socket; a tube which is shorter than the shaft being rotatably positioned around a middle portion of the shaft; a clock body being rotatably positioned around the tube and including an alarm switch thereon; a first hemispherical cover being firmly attached around the tube and received in a space defined between the alarm body and the hemispherical socket, said first hemispherical cover including an outer tab projected from an outer periphery thereof; a plurality of second hemispherical covers, each of which is received one by one, being rotatably and uniformly positioned around the shaft and received in a space defined between the first hemispherical cover and the hemispherical socket, each of the second hemispherical covers including an inner tab projected from an inner periphery thereof and an outer tab projected from an outer periphery thereof; a motor which has a mandrel being firmly positioned in the alarm body; a drive gear being firmly attached around a mandrel of the motor; a driven gear being firmly attached around the tube; a speed reducing gear set being transmissionally meshed between the drive gear and the driven gear; a normally-closed mercury switch being positioned in the alarm body; whereby when a preset alarm time is coming, the alarm clock alarms and the motor is activated to rotate to drive the first hemispherical cover and the plurality of second hemispherical covers to rotate with respect to the shaft until the outer tab of the very outer second hemispherical cover abuts against the inner tab of the hemispherical socket, which in turn causes the alarm body to rotate with respect to the tube thus turning off the mercury switch and stopping the rotation of the motor, thereafter a user rotates the first hemispherical cover and the plurality of second hemispherical covers back to their original positions and turns off the alarm by operating the alarm switch.

Further objectives and advantages of the present invention will become apparent from a careful reading of the detailed description provided hereinbelow, with appropriate reference to the accompanying drawings.

DETAILED DESCRIPTION THE PREFERRED EMBODIMENT

Figure 1:
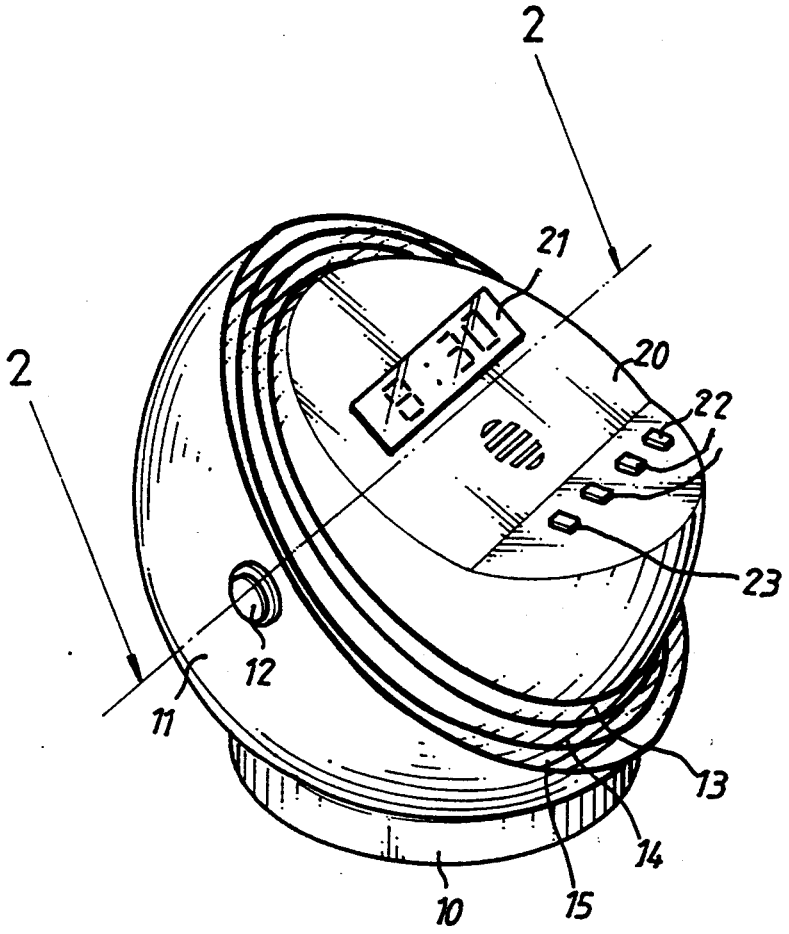
FIG. 1 is an outlook of an alarm clock in accordance with the present invention.

Referring to FIG. 1, an alarm clock in accordance with the present invention from an outlook view comprises a base 10, a hemispherical socket 11 attached on the base 10, a shaft 12 passing through an axis defined in the hemispherical socket 11 and having two distal ends attached to the hemispherical socket 11, a first hemispherical cover 13, a second hemispherical cover 14, and a third hemispherical cover 15 being received in the hemispherical socket 11 and pivoted to the shaft 12, a clock body 20 being received in the hemispherical socket 11 and pivoted to the shaft 12. The first hemispherical cover 13, the second hemispherical cover 14, the third hemispherical cover 15, and the hemispherical socket 11 each have a slightly increased diameter thus being received one by one. The number of the hemispherical covers is not limited to three. The clock body 20 includes a display 21 for showing the present time, a plurality of function buttons 22 and an alarm switch 23. The alarm switch 23 when turned off will stop an alarm from the alarm clock. The clock body 20 is well known and the detail thereof is omitted herein.

Figure 2:
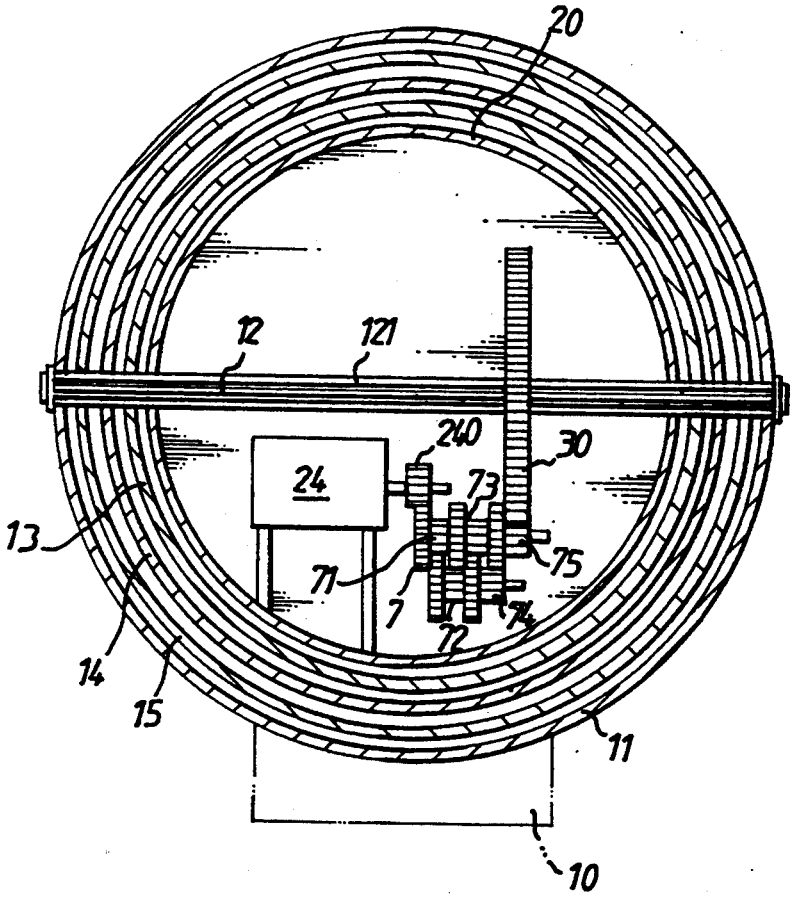
FIG. 2 is a cross-sectional view of the alarm clock in accordance with the present invention.

FIG. 2 is a cross-section view taken from lines 2—2 of FIG. 1 for illustrating the pivoted relation between the three hemispherical covers 13, 14, and 15 with respect to the shaft 12 in more detail. Referring to FIG. 2, a transmission mechanism including a motor 24, a gear 240, and a speed-reducing gear set 7 is attached on an inner wall of the clock body 20. The motor 24 has a mandrel (not labeled) firmly connected to the gear 240 which is further meshed with the speed-reducing gear set 7. The speed-reducing gear set 7 comprises a first compound gear 71, a second compound gear 72, a third compound gear 73, a fourth compound gear 74, and a fifth compound gear 75. The compound gears 71, 72, 73, 74, and 75 are meshed one by one as will be described in more detail later. A tube 121 encloses the shaft 12 and is rotatable with respect to the shaft 12. A gear 30 is firmly fixed around the tube 121 and thus is also rotatable with respect to the shaft 12. The first hemispherical cover 13 is firmly connected to the tube 121, therefore the first hemispherical cover 13 is driven to rotate by the motor 24 via a transmission through the speed-reducing gear set 7, the gear 30, and the tube 121. The clock body 20 is rotatably connected to the tube 121, therefore the clock body 20 does not rotate when the tube 121 rotates with respect to the shaft 12. The clock body 20 rotates only when the motor 24 is activated to rotate while the speed-reducing gear set 25, the gear 30, and the tube 121 is retarded to rotate with respect to the shaft 12. This condition will be described in more detail later. The tube 121 has a length substantially equaling a diameter of the first hemispherical cover 13, therefore the tube 121 is not connected to any of the second hemispherical cover 14, the third hemispherical cover 15, and the hemispherical socket 11.

Figure 3:
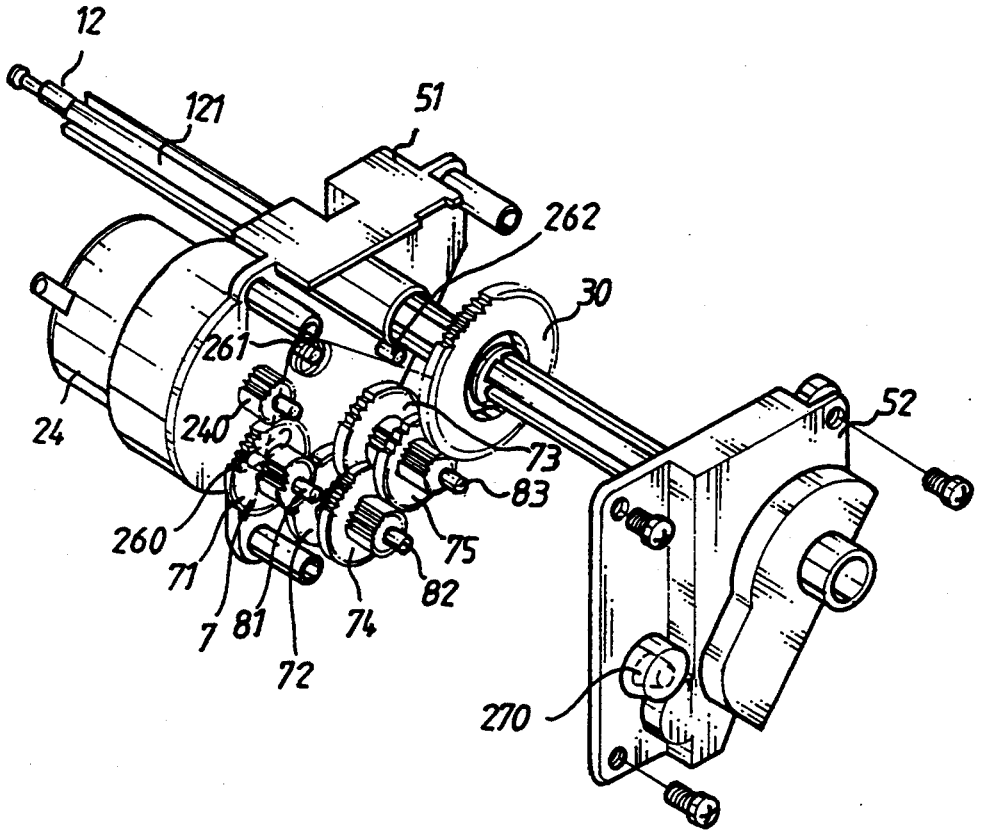
FIG. 3 is a transmission mechanism of the alarm clock of the present invention.

Referring to FIG. 3, the transmission mechanism is illustrated in more detail. Actually the motor 24 and the speed-reducing gear set 7 are fixed on a first positioning plate 51 and a second positioning plates 52. The positioning plates 51 and 52 are engaged normally, while they are separated in this figure merely for illustrative purpose. The first positioning plate 51 has a plurality of posts (not labeled) extended therefrom, therefore when the two positioning plates 51 and 52 are engaged, the speed reducing gear set 7 is positioned in a space defined between the two positioning plates 51 and 52. A curved groove 260 is defined in the first positioning plate 51 substantially along an extended circumference portion with respect to the mandrel of the motor 24. The first compound gear 71 is rotatably positioned around a first axle 81. The second compound gear 72 and the fourth compound gear 74 are rotatably positioned around a second axle 82. The third compound gear 73 and the fifth compound gear 75 are rotatably positioned around a third axle 83. The axles 81, 82, and 83 are not coplanar. The second axle 82, the third axle 83, the mandrel of the motor 24, and the shaft 12 are parallel to each other. Normally, when the motor 24 does not rotate, the first axle 81 is not parallel to the mandrel of the motor 24. The first axle 81 is parallel to the mandrel of the motor 24 only when the motor 24 rotates as will be described later. Each compound gear includes a relatively large gear and a relatively small gear firmly connected to the relatively large gear and has a T-shaped side view. The axle 81 of the first compound gear 71 has a first end positioned in the curved groove 260 of the first positioned plate 262 and a second end positioned in a cone-shaped hole 270 of the second positioning plate 52. The second axle 82 is positioned between two bosses (not shown) each respectively extended from the first positioning plate 51 and the second positioning plate 52. Similarly, the third axle 83 is positioned between two bosses (not shown) each respectively extended from the first positioning plate 51 and the second positioning plate 52. A first protrusion 261 and a second protrusion 262 are projected from the first positioning plate 51. A torsional spring 27 is fixed around the first protrusion 261 and two limbs (not labeled) thereof each respectively abut against the second protrusion 262 and the first end of the first axle 81.

Figure 4:
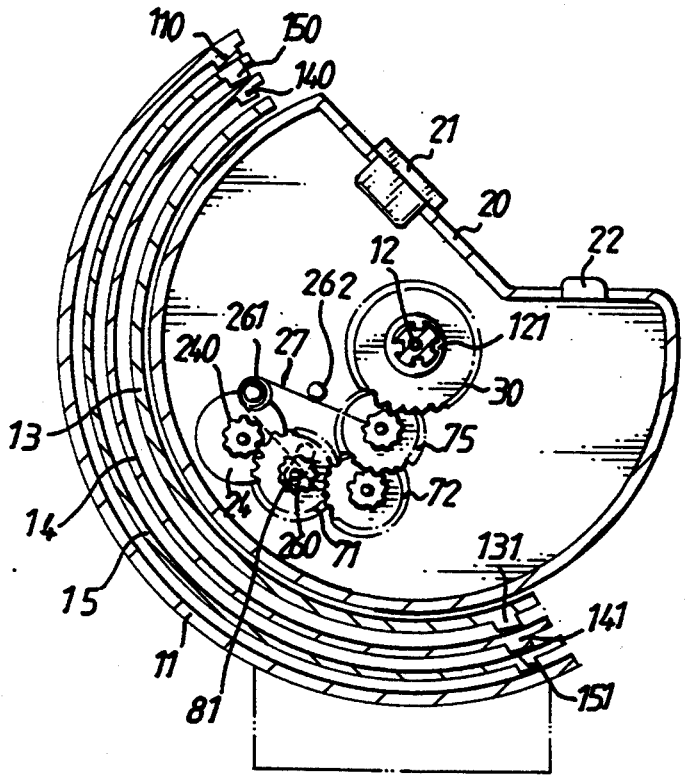
FIG. 4 is another cross-sectional view of the alarm clock of the present invention.
Figure 5:
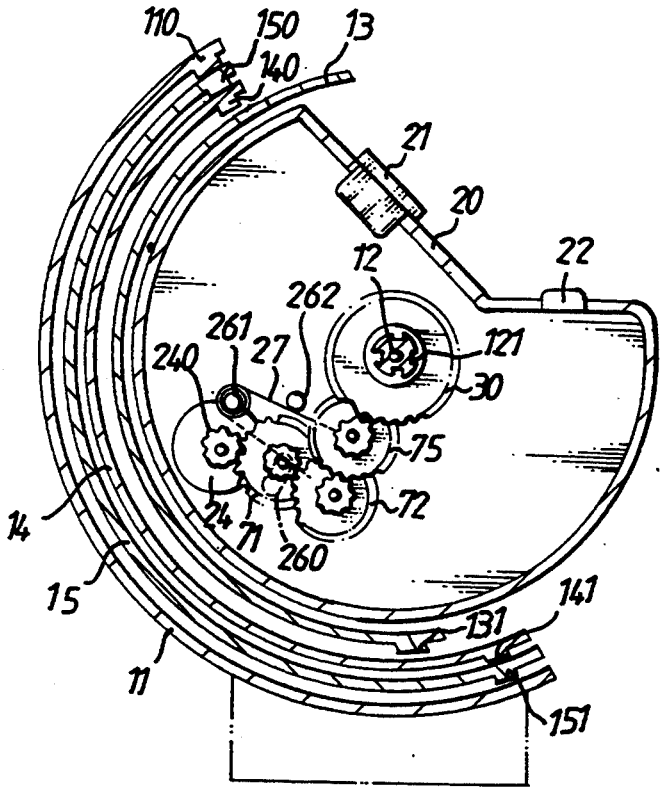
FIG. 5 is a cross-sectional view of the alarm clock illustrating a motor is engaged to a speed reducing gear set.

Referring to FIG. 4, the second hemispherical cover 14, the third hemispherical cover 15, and the hemispherical socket 11 respectively have an inner tab 140, 150, and 110 projected from an inner periphery thereof. The first hemispherical cover 13, the second hemispherical cover 14, and the third hemispherical cover 15 respectively have an outer tab 131, 141, and 151 projected from an outer periphery thereof. Normally the motor 24 does not rotate and the first end of the first axle 81 is located in a first end of the curved groove 260 due to a force from the torsional spring 27, thus causing the first compound gear 71 to disengage from the second compound gear 72 while still meshing with the gear 240. It should be noted that when the first end of the first axle 81 is located in the first end of the curved groove 260, the first axle 81 is not parallel to the mandrel of the motor 24, therefore the first compound gear 71 is slightly inclined with respect to the gear 240. It should be noted that the inclination level of the first compound gear 71 is slight thus the teeth of the first compound gear 71 are still meshed with the teeth of the gear 240. When the motor 24 rotates, the gear 240 drives the first compound gear 71 to rotate and forces the first compound gear 71 to be parallely meshed with it thus moving the first end of the first axle 81 from the first end of the groove 260 to the second end of the groove 260, meanwhile the relatively large gear of the first compound gear 71 is meshed with the gear 240 and the relatively small gear of the first compound gear 71 is meshed with the relatively large gear of the second compound gear 72 as shown in FIG. 5. Once the motor 24 is in rotation, the torsional spring 27 cannot force the first compound gear 71 to disengage from the second compound gear 72. It can be understood that the rotation of the gear 240 overcomes the force from the torsional spring 27. In simplification, the relatively small gear of the first compound gear 71 is driven to be meshed with the second compound gear 72 by the motor 24 via a transmission of the gear 240. It should be noted that for simplification the third compound gear 73 and the fourth compound gear 74 are omitted from FIGS. 4, 5, and 6.

Figure 7:
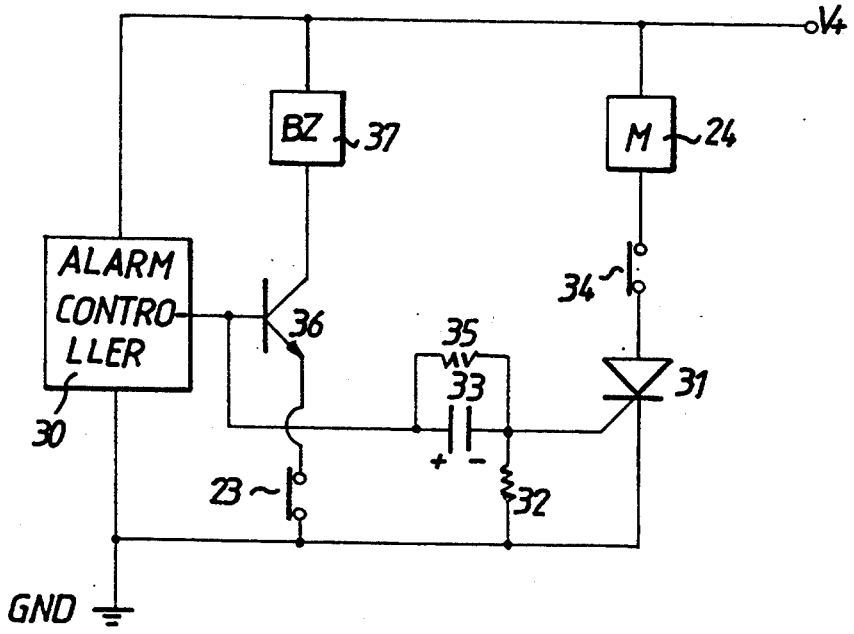
FIG. 7 is a circuit diagram in accordance with the present invention for controlling rotation of a motor.

Referring to FIG. 7, a control circuit for controlling the rotation of the motor 24 is illustrated. The control circuit comprises a preprogrammed alarm controller 30 connected between a voltage source V+ and a ground GND for outputting a triggering signal from an output terminal thereof when a preset alarming time is coming. A buzzer 37, a transistor 36, and the alarm switch 23 are serially connected between the voltage source V+ and the ground GND. Suppose the alarm switch 23 is manually set to an on status. The transistor 36 is an NPN-type transistor and has a collector connected to the buzzer 37, an emitter connected to the ground GND via the alarm witch 23, and a base connected to the output terminal of the alarm controller 30. The transistor 36 is normally in an "off" status and is turned on by the triggering signal from the alarm controller 30 when the preset time of the alarm clock is coming. The motor 24, a normally-closed mercury switch 34, and a silicon-controlled rectifier (SCR) 31 are serially connected between the voltage source V+ and the ground GND, where the SCR 31 has an anode thereof connected to the normally-closed mercury switch 34, a cathode; connected to the ground GND, and a gate connected to the output terminal of the alarm controller 30 via a pair of shunted resistor 35 and capacitor 33. Another resistor 32 is connected between the gate of the SCR 31 and the ground GND. The SCR 31 is triggered to an on status when the alarm controller 30 outputs the triggering signal. The motor 24 is activated to rotate when the normally-closed mercury switch 34 remains in a closed status and the SCR 31 is in an on status. It should be noted that the normally-closed mercury switch 34 is firmly positioned in the clock body 20 therefore when the clock body rotates to a predetermined angle, the normally-closed mercury switch 34 will be changed to an open status. The buzzer 37 alarms when the alarm switch 23 is set to an on status and the preset alarming time is coming. It is further noted that when the motor 24 stops rotation, the buzzer 37 still alarms, unless the user turns off the alarm switch 23.

Figure 6:
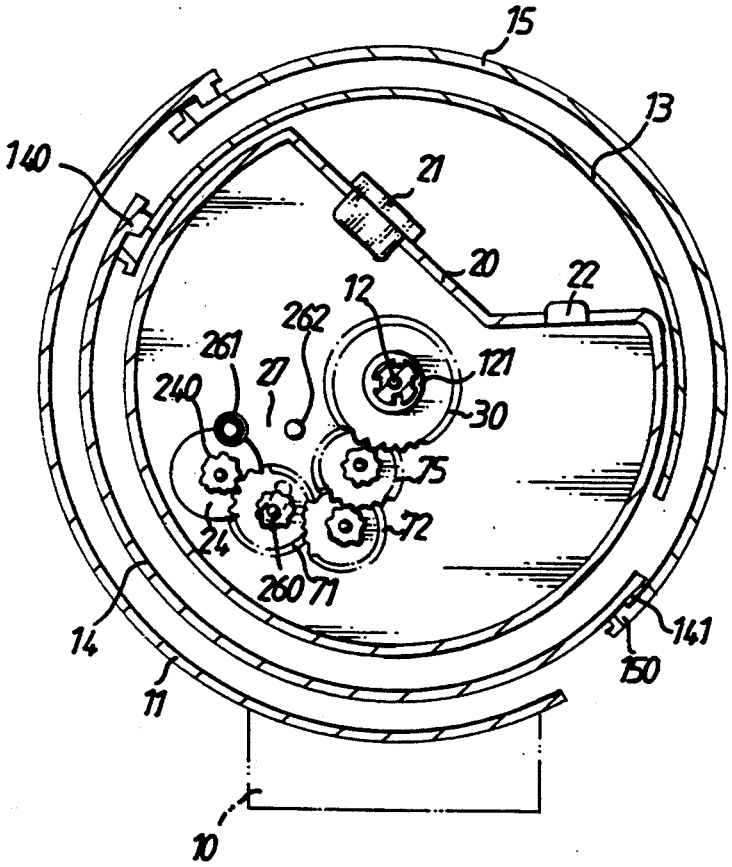
FIG. 6 is a cross-sectional view of the alarm clock illustrating the motor of FIG. 5 is disengaged from the speed reducing gear set.

FIG. 5 illustrates the alarm clock starting to alarm and the first hemispherical cover 13 starts to rotate in a clockwise direction. When the alarm clock is alarming, the first hemispherical cover 13 is driven by the motor 24 to rotate with respect to the shaft 12 via a transmission through the speed reducing gear set 25, the gear 30, and the tube 121. The outer tab 131 of the first hemispherical cover 13 abuts against the inner tab 140 of the second hemispherical cover 14 after the first hemispherical cover 13 has been driven to rotate for substantially a half circle by a transmission through the motor 24, the speed reducing gear set 7, the gear 30, and the tube 121; thereafter, the second hemispherical cover 14 is driven by the motor 24 via a transmission through the motor 24, the speed reducing gear set 25, the gear 30, and the tube 121 to rotate for substantially a half circle and the outer tab 141 of the second hemispherical cover 14 abuts against the inner tab 150 of the third hemispherical cover 15; thereafter the third hemispherical cover 15 is driven by the motor 24 via a transmission through the speed reducing gear set 25, the gear 30, the tube 121, the first hemispherical cover 13, and the second hemispherical cover 14 to rotate for substantially a half circle and the outer tab 151 of the third hemispherical cover 15 abuts against the inner tab 110 of the hemispherical socket 11 preventing the motor 24, the speed reducing gear set 7, the gear 30, the tube 121, the three hemispherical covers 13, 14, and 15 from rotation as shown in FIG. 6. After then, the clock body 20 rotates in a counter-clockwise direction with respect to the tube 121 because the motor 24 attached to the clock body 20 is still in an "on" status while the mandrel thereof is prevented from rotation due to the block of the inner tab 110 of the hemispherical socket 11. The motor 24 stops rotating when the clock body 20 rotates to a predetermined angle. It is noted that when the clock body 20 rotates to the predetermined angle, the mercury switch 34 is changed from a closed status to an open status thus cutting off power supplying to the motor 24 and stopping the rotation of the motor 24. It is further noted that when the motor 24 stops rotation, the buzzer 37 still sounds. The first end of the axle of the first compound gear 71 is driven by the torsional spring 27 to move from the second end of the curved groove 260 to the first end of the curved groove 260, thus disengaging the first compound gear 71 from the compound gear 28. Thereafter, the user can easily move the hemispherical covers 13, 14, and 15 back to the original status as shown in FIG. 4 and turn off the alarm switch 23 thus turning off the alarm from the buzzer 37 (see FIG. 7).

In a second embodiment, the curved groove 260 and the cone-shaped hole 270 are replaced with two bosses (not shown) each for respectively receiving one end of the axle of the first compound gear 71. The first axle 81 in the second embodiment is parallel to the mandrel of the motor 24 at all times, therefore the first compound gear 71 is at all times meshed between the gear 240 and the second compound gear 72. It should be noted that in the second embodiment the user has to make considerable effort to recover the three covers 13, 14, and 15 back to the original status as shown in FIG. 4, since the user has to overcome resistance of the mandrel of the motor 24 in addition to the resistance between the gears. With the second embodiment of the alarm clock, the user is ensured to be fully conscious if he/she can return the covers 13, 14, and 15 to the original statuses.

While the present invention has been explained in relation to its preferred embodiment, it is to be understood that various modifications thereof will be apparent to those skilled in the art upon reading this specification. Therefore, it is to be understood that the invention disclosed herein is intended to cover all such modifications as fall within the scope of the appended claims.

I claim:

1. A rotatable alarm clock comprising a base;

a hemispherical socket attached on the base and including an inner tab projected from an inner periphery thereof;

a shaft passing through an axis defined in the hemispherical socket and having two distal ends attached to the hemispherical socket;

a tube which is shorter than the shaft being rotatably positioned around a middle portion of the shaft;

a clock body being rotatably positioned around the tube and including an alarm switch thereon;

a first hemispherical cover being firmly attached around the tube and received in a space defined between the alarm body and the hemispherical socket, said first hemispherical cover including an outer tab projected from an outer periphery thereof;

a plurality of second hemispherical covers, each of which is received one by one, being rotatably and uniformly positioned around the shaft and received in a space defined between the first hemispherical cover and the hemispherical socket, each of the second hemispherical covers including an inner tab projected from an inner periphery thereof and an outer tab projected from an outer periphery thereof;

a motor which has a mandrel being firmly positioned in the alarm body;

a drive gear being firmly attached around a mandrel of the motor;

a driven gear being firmly attached around the tube;

a speed reducing gear set being transmissionally meshed between the drive gear and the driven gear;

a normally-closed mercury switch being positioned in the alarm body;

whereby when a preset alarm time is coming, the alarm clock alarms and the motor is activated to rotate to drive the first hemispherical cover and the plurality of second hemispherical covers to rotate with respect to the shaft until the outer tab of the very outer second hemispherical cover abuts against the inner tab of the hemispherical socket, which in turn causes the alarm body to rotate with respect to the tube thus turning off the mercury switch and stopping the rotation of the motor, thereafter a user rotates the first hemispherical cover and the plurality of second hemispherical covers back to their original positions and turns off the alarm by operating the alarm switch.

2. A rotatable alarm clock as claimed in claim 1, wherein the spring-biased compound gear is biased by a torsional spring.

3. A rotatable alarm clock comprising a base;

a hemispherical socket attached on the base and including an inner tab projected from an inner periphery thereof;

a shaft passing through an axis defined in the hemispherical socket and having two distal ends attached to the hemispherical socket;

a tube which is shorter than the shaft being rotatably positioned around a middle portion of the shaft;

a clock body being rotatably positioned around the tube and including an alarm switch thereon;

a first hemispherical cover being firmly attached around the tube and received in a space defined between the alarm body and the hemispherical socket, said first hemispherical cover including an outer tab projected from an outer periphery thereof;

a plurality of second hemispherical covers, each of which is received one by one, being rotatably and uniformly positioned around the shaft and received in a space defined between the first hemispherical cover and the hemispherical socket, each of the second hemispherical covers including an inner tab projected from an inner periphery thereof and an outer tab projected from an outer periphery thereof;

a motor which has a mandrel being firmly positioned in the alarm body;

a drive gear being firmly attached around a mandrel of the motor;

a driven gear being firmly attached around the tube;

a spring-biased compound gear meshed to the drive gear;

a speed-reducing gear set meshed with the driven gear;

a normally-closed mercury switch being positioned in the alarm body;

whereby the spring-biased compound gear is engaged to the speed-reducing gear set when the motor rotates, thus when a preset alarm time is coming, the alarm clock alarms and the motor is activated to rotate to drive the first hemispherical cover and the plurality of second hemispherical covers to rotate with respect to the shaft via a transmission through the drive gear, the spring-biased compound gear, the speed-reducing gear set, and the driven gear, until the outer tab of an outer most of second hemispherical covers abuts against the inner tab of the hemispherical socket, which in turn causes the alarm body to rotate with respect to the tube thus turning off the mercury switch and stopping the rotation of the motor, which in turn causes the spring-biased compound gear to disengage from the speed-reducing gear set, thereafter a user rotates the first hemispherical cover and the plurality of second hemispherical covers back to their original positions and turns off the alarm by operating the alarm switch.

4. A rotatable alarm clock comprising a clock body rotatably positioned around a tube which is rotatably positioned around a shaft which is firmly fixed in an inner space of a hemispherical socket which is firmly fixed on a base;

a motor firmly positioned in the clock body and including a mandrel;

a transmission means connected between the mandrel of the motor and the tube;

a first hemispherical cover firmly attached around the tube and including an outer tab projected from an outer periphery thereof;

at least a second hemispherical cover rotatably positioned around the shaft and including an outer tab projecting from an outer periphery thereof and an inner tab projected from an inner periphery thereof, the inner tab of the at least one second hemispherical cover abutting against the outer tab of the first hemispherical cover when the first hemispherical cover is driven to rotate for substantially a half circle;

a control circuit for activating the motor to rotate when a preset alarming time is coming and stopping rotation of the motor when the clock body rotates;

whereby the motor rotates to drive the first hemispherical cover and the at least one second hemispherical cover to rotate until the at least one second hemispherical cover is blocked by the hemispherical inner tab, thereafter the clock body rotates and causes the control circuit to stop the rotation of the motor.

5. A rotatable alarm clock as claimed in claim 4, wherein the transmission means comprises a drive gear firmly positioned around the mandrel of the motor, a driven gear firmly positioned around the tube, and a speed-reducing gear set meshed between the drive gear and the driven gear.

6. A rotatable alarm clock as claimed in claim 5, wherein the speed-reducing gear set comprises a first compound gear meshed between the drive gear and a second compound gear which is meshed with a third compound gear which is meshed with a fourth compound gear which is meshed with a fifth compound gear which is meshed with the driven gear.

7. A rotatable alarm clock as claimed in claim 5, wherein the speed-reducing gear set comprises a first compound gear meshed with the drive gear and biased by a torsional spring, a second compound gear meshed with a third compound gear meshed with a fourth compound gear meshed with a fifth compound gear meshed with the driven gear, whereby the first compound gear is normally disengaged from the second compound gear due to a force from the torsional spring and is engaged to the second compound gear when the first compound gear is driven to rotate by the motor via the drive gear.

8. A rotatable alarm clock as claimed in claim 4, wherein the control circuit comprises an alarm controller connected between a voltage source and a ground for outputting a triggering signal from an output terminal thereof when the preset alarm time is coming, a silicon-controlled rectifier, a normally-closed mercury switch, and the motor being connected in series between the voltage source and the ground, the silicon-controlled rectifier including a gate connected to the output terminal of the alarm controller and being activated to an on status when the alarm controller outputs the triggering signal.

9. A rotatable alarm clock as claimed in claim 8, wherein the normally-closed mercury switch is firmly positioned in the clock body thus when the clock body rotates the normally-closed mercury switch is changed from a normally-closed status to an open status thus stopping rotation of the motor.

10. A rotatable alarm clock as claimed in claim 8, wherein the control circuit further comprises a buzzer, a transistor, and a switch connected in series between the voltage source and the ground, the transistor including a base connected to the output terminal of the alarm controller and being activated to an on status when the alarm controller outputs the triggering signal.

* * * * *